US009307810B2

(12) United States Patent
Himi

(10) Patent No.: US 9,307,810 B2
(45) Date of Patent: Apr. 12, 2016

(54) DECORATED SLIDE FASTENER

(75) Inventor: Naoyuki Himi, Toyama (JP)

(73) Assignee: YKK Corporation (JP)

( * ) Notice: Subject to any disclaimer, the term of this patent is extended or adjusted under 35 U.S.C. 154(b) by 98 days.

(21) Appl. No.: 14/111,294

(22) PCT Filed: Apr. 12, 2012

(86) PCT No.: PCT/GB2012/050810
§ 371 (c)(1),
(2), (4) Date: Oct. 11, 2013

(87) PCT Pub. No.: WO2012/140431
PCT Pub. Date: Oct. 18, 2012

(65) Prior Publication Data

US 2015/0121663 A1 May 7, 2015

(30) Foreign Application Priority Data

Apr. 13, 2011 (GB) ..... 1106285.8

(51) Int. Cl.

| | |
|---|---|
| ***A44B 19/08*** | (2006.01) |
| ***A44B 19/42*** | (2006.01) |
| ***A44B 19/02*** | (2006.01) |
| ***A44B 19/04*** | (2006.01) |
| ***A44B 19/26*** | (2006.01) |

(52) U.S. Cl.
CPC ..... *A44B 19/08* (2013.01); *A44B 19/02* (2013.01); *A44B 19/04* (2013.01); *A44B 19/262* (2013.01); *A44B 19/42* (2013.01); *Y10T 24/2539* (2015.01); *Y10T 24/2543* (2015.01)

(58) Field of Classification Search
CPC ..... A44B 19/08; A44B 19/42; A44B 19/262; A44B 19/04; A44B 19/02; Y10T 24/2543; Y10T 24/2539
See application file for complete search history.

(56) References Cited

U.S. PATENT DOCUMENTS 2,495,033 A * 1/1950 Sullivan ..... 24/410
3,028,647 A 4/1962 Greenberg
(Continued)

FOREIGN PATENT DOCUMENTS

CH 308551 A 7/1955
CN 2285075 Y 7/1998
(Continued)

OTHER PUBLICATIONS

International Search Report, PCT Application No. PCT/GB2012/050810, mailed Jun. 19, 2012.
(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A slide fastener including a pair of first and second stringers each including a tape and a row of coupling elements mounted on one longitudinal edge of the tape; wherein each of the coupling elements includes a first non-connecting portion and a second connecting portion and wherein the second connecting portion includes a head portion and a body portion; and wherein the first non-connecting portion includes an attachment surface to which a decorative element is attached and the attachment surface has a first surface and a second surface lower than the first surface. The decorative element is attached to the second surface.

16 Claims, 6 Drawing Sheets

(56) References Cited

U.S. PATENT DOCUMENTS

| | | | | | |
|---|---|---|---|---|---|
| 3,825,978 | A | * | 7/1974 | Sakalys | 24/410 |
| 4,635,324 | A | * | 1/1987 | Hoerkens | 24/413 |
| 4,922,585 | A | | 5/1990 | Suzuki et al. | |
| 5,511,292 | A | | 4/1996 | Covi et al. | |
| 5,588,185 | A | | 12/1996 | Covi et al. | |
| 5,713,110 | A | | 2/1998 | Covi et al. | |
| 6,092,267 | A | | 7/2000 | Covi et al. | |
| 2006/0260104 | A1 | * | 11/2006 | Himi | 24/403 |

FOREIGN PATENT DOCUMENTS

| | | | |
|---|---|---|---|
| CN | 2293229 | Y | 10/1998 |
| CN | 201403619 | Y | 2/2010 |
| JP | S30-15033 | | 10/1930 |
| JP | 49-001340 | A | 1/1974 |
| JP | S64-020805 | A | 1/1989 |
| JP | S64-020806 | A | 1/1989 |
| JP | 1031757 | | 2/1999 |
| JP | 2001-019724 | A | 1/2001 |
| JP | 2006-320642 | A | 11/2006 |
| TW | 224577 | | 6/1994 |
| TW | 265926 | | 12/1995 |
| TW | I317266 | | 11/2009 |
| WO | 00/27237 | | 5/2000 |

OTHER PUBLICATIONS

Office Action, Japanese Patent Application No. 2013-555942, mailed Mar. 24, 2015.

Office Action, Taiwanese Patent Application No. 101113404, mailed Jun. 18, 2014.

Office Action, Japanese Patent Application No. 2013-555942, mailed Jul. 29, 2014.

* cited by examiner

DECORATED SLIDE FASTENER

This application is a national stage application of PCT/GB2012/050810 which claims priority to British Patent No. 1106285.8, both of which are incorporated herein by reference.

TECHNICAL FIELD

The present invention relates to a slide fastener, more specifically to a slide fastener comprised of plastics material with adorned ornamentation.

BACKGROUND

With the ever present desire to produce new designs for the fashion and home furnishings and other industries the nature of slide fastener or zipper on a particular garment or article can have a significant effect on the overall look of the finished article. This holds true for all aspect of the slide fastener ranging from the coupling elements to the slider and the pull tab for the slide fastener.

However, whilst often requiring an attractive appearance, a slide fastener still possesses a functional role which ensures successful operation of the garment, home furnishing or other item.

A problem associated with slide fasteners is the inherent nature of the coupling elements or fastener teeth that form the closure mechanism for the slide fastener to receive foreign materials. The presence of the foreign materials, if left unchecked may damage the closure mechanism by preventing movement of a slider along the length of the slide fastener. In addition, removal of the foreign body may result in damage to the coupling elements such that the slide fastener no longer closes.

This is particularly the case for plastic coupling elements which may be easily damaged by the presence of errant plastic fibres generated during the manufacturing process and which if left unchecked can lead to abrading of the edges of the coupling elements.

For this reason, the embellishment of coupling elements comprised of plastics material which are of a sufficient strength to withstand the operation of the slide fastener yet still have a suitably attractive appearance has been a significant challenge to slide fastener manufactures. For example, the molding of coupling elements comprised of plastic material with the provision of holes or indents for receiving ornamentation such as jewels or beads increases the likelihood of plastic fibres arising which can remain on the teeth until the decorated slide fastener has been used a number of times. The wear of the coupling elements subsequently leads to the fibres becoming detached from the coupling elements but at the same time increases the chance of the fibres becoming trapped in between the coupling elements and thereby causing damage.

In addition, the decorative elements used to adorn clothing and hence slide fasteners such as beads and crystals are not only difficult to handle but are also costly to manufacture and utilise. Consequently, when a slide fastener is embellished with such crystals and decorative beads it is important that the decorative element is not only retained securely in place on the slide fastener but also that the decorative elements are protected from excessive wear and damage which could ultimately lead to the decorative elements loosing their lustre.

There is therefore a need to provide a slide fastener in which the coupling elements are comprised of plastics material and for which the slider or the pull tab can also be comprised of plastics material and for which the various parts of the slide fastener can be attractively embellished without the generation of errant fibres. There is also a need to provide a slide fastener in which once the various component parts of the slide fastener have been decorated or adorned can withstand the rigours of everyday use on the particular garment or soft furnishing to which the slide fastener is attached, which does not possess any rough edges on for example the coupling elements, and which is attractive in appearance and furthermore still possess an efficient closure mechanism compared with existing slide fasteners. Furthermore, there is also a need to provide a slide fastener in which once decorative elements have been secured to the slide fastener the decorative elements are themselves protected from damage.

In conventional slide fasteners there is usually provided a pair of fastener tapes upon which are mounted rows of individual coupling elements which cooperate or interdigitate when the fastener tapes pass through a slider mounted on one of the fastener tapes and in so doing either close or open the slide fastener accordingly.

However, the interdigitation of the coupling elements has a limiting effect on the visible appearance of the slide fastener. That is, due to the required interconnection of the coupling elements needed to ensure a sufficient closing of the slide fastener, the design of the external appearance of the slide fastener has been strictly limited not least of all because the coupling elements are required to pass through the slider.

In addition, the interconnection of the coupling elements visible to the user on the front and rear of the fastener has limited the flexibility of the slide fastener in the closed position and also the separation between the individual fastener elements on opposing fastener tapes. Furthermore, the need to ensure an efficient closure of the coupling elements has lead to restrictions in the positioning of any decorative elements on for example the coupling elements.

There have been various attempts to embellish the outer appearance of for example the coupling elements, slider or pull tab of the slide fastener.

For example, in U.S. Pat. No. 3,028,647 there is described a lock for a zipper or slide fastener in which both the lock and teeth of the zipper comprise 'brilliants' or jewels as ornamentation. However, there are no details in U.S. Pat. No. 3,028,647 as to how the brilliants are secured or retained in place on the coupling elements and the interdigitation of the coupling elements is achieved by small protrusion on each coupling elements which are received by an opening on an adjacent coupling element and which are prone to damage and prevent close packing of the coupling elements.

In U.S. Pat. No. 5,511,292 (Covi et al) there is disclosed a zipper comprising a first and second row of teeth formed on a first and second band, each band comprising an edge bead or web. The teeth have free ends, and each have a channel such that when said zipper is being closed the free ends of said first row of teeth extend into an area of attachment of the teeth of the second row of teeth and vice versa, whereby the channels receive the edge beads or webs. The zipper further comprises a slider with a top cover plate and a bottom cover plate connected by a cross-piece, said slider having a wider front end and a narrower back end, said cross-piece having a front end directed towards said wider front end of said slider and a back end directed towards said narrower back end of said slider.

In addition, decorative stones are arranged on the teeth and also on the pull tab. However, there are no details provided as to how the teeth are secured and maintained in place. The decorative stones are substantially centrally located with respect to the teeth and protrude out of the plane of the teeth. Consequently the stones are prone to damage.

In U.S. Pat. No. 5,588,185, also by Covi et al, there is described a zipper which again includes teeth or coupling elements having decorative stones. Details are provided as to how the teeth engage each other and the size of the support surfaces and extensions on the teeth relative to the diameter of the decorative stones. Likewise details are provided with respect to how the decorative stones can be arranged in a straight line and with a narrow spacing in comparison to their size even when the support surfaces on the teeth are relatively small, due to the extension of the stones at a sharp angle to the direction of the teeth which ensures that the submerged part of each stone is surrounded by a satisfactory amount of plastic material. However, U.S. Pat. No. 5,588,185 is silent as to how the stones are satisfactorily secured in place and again, even though the stones protrude out of the plane of the teeth there is no mention of how damage to the stones can be prevented.

In U.S. Pat. No. 5,713,110 also by Covi et al there is again described a zipper comprised of first and second rows of plastic teeth formed on first and second bands, each band having an edge bead. The teeth have free ends and opposed back ends fixed to the bands. Close to the back ends of the teeth are decorative stones wherein each decorative stone has a tapered portion with a tip, and the tip is directed to the respective band. The stones are formed in the teeth during injection molding but are mounted close to the rear edge of the teeth so that the front edges of the teeth can engage to a sufficient amount to effect closure of the zipper. The stones protrude out of the plane of the teeth and there is no mention as to how damage to the stones can be prevented.

In U.S. Pat. No. 6,092,267, again by Covi et al there is described a zipper including first and second rows of teeth formed on first and second bands. Each tooth has a free end in which a channel is formed. Each channel has a bottom which is convexly curved. The zipper includes a slider with a projection for opening and closing the zipper and decorative stones are arranged in a straight line along the zipper by the spacing between the stones being small in comparison to the size of the stones and the support surfaces for the stones on the teeth being kept correspondingly small. The arrangement of the invention allows each stone to be adequately surrounded by plastic material while nonetheless the spacing between successive stones being small. The stones are embedded in substantially the centre of the teeth to allow suitable connection between protrusions residing on the sides of the plastic teeth. There is no mention as to how the stones may be protected from damage.

However, in the prior art patents described above, each stone significantly protrudes from the outer surface of the tooth to which it is attached. Consequently, sliders present on the zippers have to negotiate the raised stones which can also lead to interference of the slider and damage thereto as well as damage to the stones which can result in reduced lustre.

In International Publication No. WO/2000/027237 there is disclosed a jewelry article in which jewelry stones are injected into a support body made of plastic. The jewelry stones are arranged on both sides of a flat support body. The invention makes it possible for the support body to be produced in two successive injection molding processes and, during a second method step, for all of the jewelry stones to rest on an injection molded part produced in a first method step. However, the jewelry stones still protrude out of the plane of the injected molded surface which means that the jewelry stones are prone to damage and may also cause damage through interaction with other soft materials.

Likewise in Japanese Utility Model Publication, Utility Model Application Publication No. S30-15033, Japanese Design Publication, Registered Design No. 1031757, Chinese Design Patent Publication No. CN 3066227, Taiwanese Patent Publication, Publication No. 265926, and Chinese Utility Model Publication No. CN 2285075Y there are disclosed teeth for zippers, all of which comprise jewels which protrude from an outer or upper face of the teeth and for which no further protection is afforded.

In Chinese Utility Model Publication No. CN 2293229Y there is disclosed a zipper tooth or coupling element with a groove for receiving a projecting stone and in which the platform for the stone is also curved thereby providing an impediment for the smooth movement of a slider along a zipper.

SUMMARY

The present invention therefore seeks to overcome the problems associated with the prior art zippers and coupling elements in that front or outwardly facing coupling elements of the slide fastener are provided with attractive ornamentation whilst still retaining the required flexibility and strength required for modern slide fasteners and whilst still providing a sleek and attractive appearance of the slide fastener. In addition, the ornamentation does not provide any impediment for the smooth movement of a slider along the zipper and the ornamentation are also protected from damage.

Surprisingly, the inventors of the present invention have now found that the herein described coupling elements can be embellished with jewels and/or beads in a sufficiently strong and effective manner whilst not impairing the closure mechanism and whilst also affording protection for the ornamentation. In addition, the insertion of the ornamentation or jewels into the teeth in accordance with the present invention allows the jewels to be optionally positioned in the coupling elements.

The present invention finds particular application as an improved slide fastener for the clothing and soft furnishings industry, but it not limited thereto.

The present invention therefore seeks to address the problems outlined above and provides an improved slide fastener that is able to meet the stringent requirements of modern slide fasteners and the aesthetic requirements of modern designs.

Therefore according to a first aspect of the present invention there is provided a slide fastener comprising:

a pair of first and second stringers each comprising a tape and a row of coupling elements mounted on one longitudinal edge of the tape; wherein each of the coupling elements comprises a first non-connecting portion and a second connecting portion and wherein the second connecting portion comprises a head portion and a body portion; and wherein the first non-connecting portion comprises an attachment surface to which a decorative element is attached and the attachment surface has a first surface and a second surface lower than the first surface, and wherein the decorative element is attached to the second surface.

In accordance with the present invention the coupling elements are comprised of plastic. In addition, the decorative element comprises a bead or a crystal and does not substantially protrude beyond the first surface of each of the coupling elements.

Also according to the present invention the decorative element comprises an upper portion and a lower portion and an upper surface of the upper potion is substantially flat. Furthermore, the first non-connecting portion comprises a raised portion and the raised portion comprises the first surface. This raised portion at least partially surrounds the decorative element. However, as an alternative embodiment, the raised portion may completely surround the decorative element.

Further according to the present invention the first non-connecting portion comprises a recessed region in addition to a groove for receiving the decorative element. The recessed region comprises a recessed portion and the recessed portion comprises the second surface.

If required, the decorative elements may be adhered to the non-connecting portion of the coupling elements to ensure that the decorative elements are not lost through wear.

Furthermore, it may be preferred that when present a slider on the slide fastener may also be comprised of plastic material and also comprise decorative elements.

If the slider further comprises a pull tab then the pull tab may also be comprised of plastic material and comprises decorative elements.

In a first preferred embodiment of the present invention the first non-connecting portion has a tapered region.

Also according to the present invention the second connecting portion preferably comprises an indented region and a protruding region for engaging adjacent coupling elements.

According to a second aspect of the present invention there is provided a method of preparing a slide fastener comprising the steps of:

securing a series of coupling elements along a longitudinal length of facing sides of a tape forming each stringer of the slide fastener by injection moulding plastic material;

wherein the coupling elements are as described in relation to the first aspect of the present invention; and wherein one or more decorative elements are applied and secured to one or more of the coupling elements.

In accordance with the second aspect of the present invention the coupling elements are re-heated prior to insertion of the decorative elements. Furthermore, the decorative elements may be further secured to the coupling elements by adhesive.

In the method according to the second aspect of the present invention the coupling elements are re-heated using sonic or radio waves prior to insertion of the decorative elements. These sonic or radio waves could be in the form of for example, radiowaves, microwaves or sonic waves.

According to a third aspect of the present invention there is provided the use of a slide fastener according to the first aspect of the present invention for clothing and/or furnishings.

Further aspects and preferred features of the invention will be apparent from the following description and the accompanying claims.

BRIEF DESCRIPTION OF DRAWINGS

The invention will now be further described by way of example with reference to the accompanying drawings, in which.

EMBODIMENTS

Figure 1:
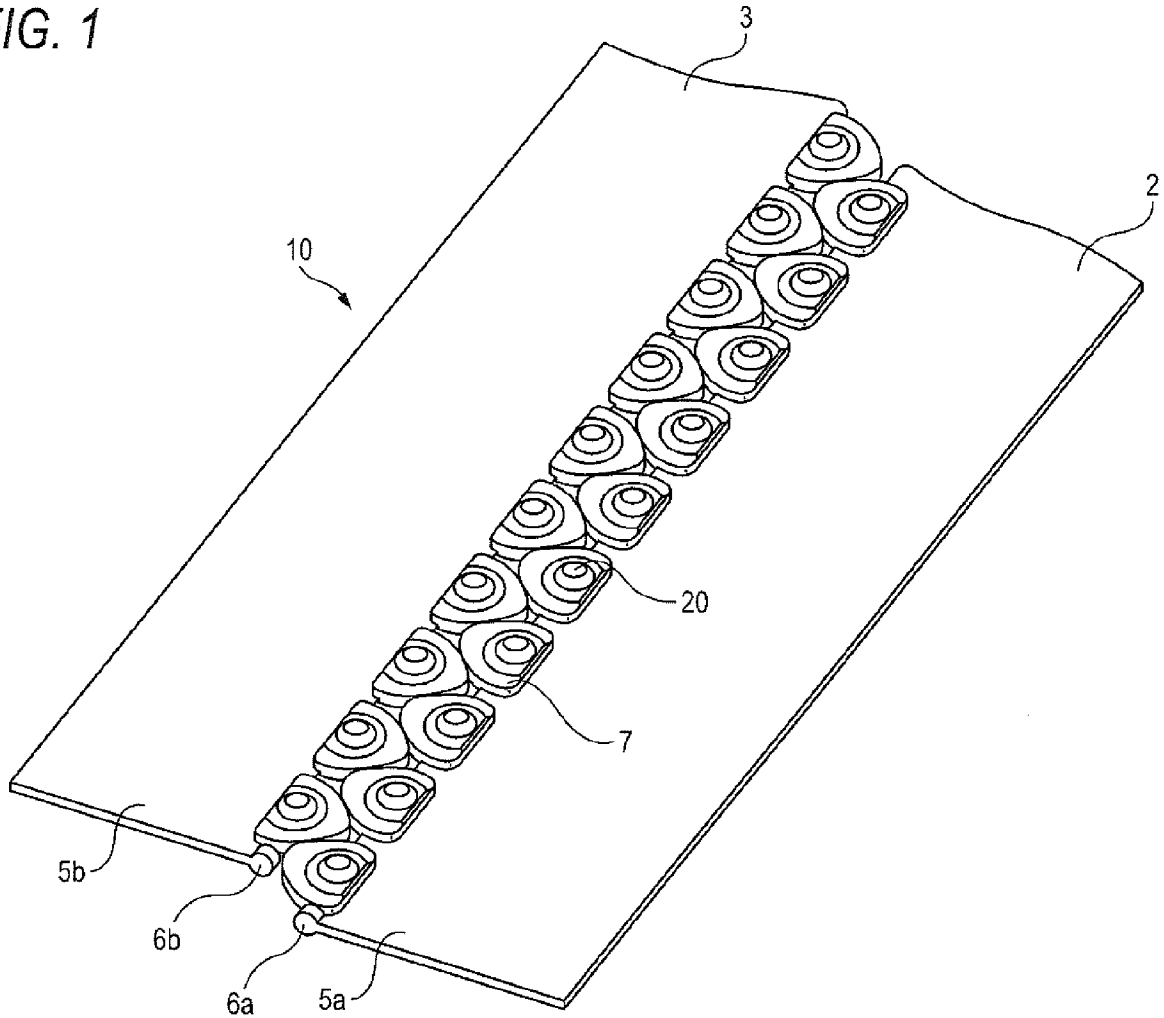
FIG. 1 is a perspective view of an embodiment of a slide fastener according to the present invention.

Referring to FIG. 1 there is illustrated a slide fastener (10) in accordance with the first embodiment of the present invention. In FIG. 1, the slide fastener is in a substantially closed position illustrating the interdigitation of the coupling elements as they pass through a slider (not shown).

The slide fastener (10) of FIG. 1 comprises a pair of first stringer (2) and second stringer (3). Each stringer (2, 3) is comprised of a tape (5*a* and 5*b*) and a row of coupling elements (7) which are attached to one longitudinal edge of the tape. The edge of each tape is provided with a cord (6*a* and 6*b*) which protrudes from the upper and lower faces of the tape and upon which the coupling elements (7) are mounted. The slider (not shown) preferably comprises a pull tab (not shown) to allow a user to move the slider along the row of the coupling elements and in so doing separate the coupling elements of the first stringer and the coupling elements of the second stringer to open the slide fastener or engages the coupling elements of the first stringer and the coupling elements of the second stringer to close the slide fastener.

In the embodiment of the slide fastener illustrated in FIG. 1, the coupling elements are comprised of plastic material and have been prepared by injection moulding. The coupling elements are mounted along the cord (6*a* and 6*b*).

At one end of the stringers (2, 3) the slide fastener may comprise a retaining box and an insert pin (not shown) mounted on the respective tapes (5*a*, 5*b*) to enable the stringers (2, 3) to be coupled together as is well known in the art of slide fasteners. The first and second stringers (2, 3) of the slide fastener (10) are preferably separable as is also known in the art.

A key feature of the slide fastener of the present invention as illustrated in the figures is the nature of the coupling elements (7). As can be seen in FIG. 1, the coupling elements are also fitted or adorned with decorative elements (20) which may crystals, beads, jewels or mixtures thereof. The decorative elements may be comprised of for example glass or coloured plastic material. It is preferred however that the decorative elements are comprised of crystal.

In the embodiment shown in FIG. 1, the decorative elements (20) are located towards the outer edge of the coupling elements away from the tape edges. Consequently, when the slider moves along the slide fastener and the coupling elements are interdigitated, the decorative elements form a substantially straight line in line with the slider.

The pull tab may also comprise the same decorative elements in the form of jewels, beads or crystals.

The decorative elements (20) in the form of beads, crystals or jewels are secured to the plastic coupling elements to prevent loss of the decorative elements.

A further key feature of the coupling elements of the present invention, however, is the fact that the decorative elements are recessed into the coupling elements. The decorative elements may protrude by a small amount from the top surfaces of the coupling elements or alternatively, depending on the size of the decorative elements the decorative elements may extend by a limited amount, but not enough to cause interference with the movement of the slider along the slide fastener. Consequently, the decorative elements do not pose any resistance to the movement of the slider along the slide fastener.

As seen in FIG. 1, the coupling elements are arranged such that the coupling elements on opposing tapes are offset with respect to one another in the longitudinal direction of the tape. The shape of the coupling elements ensures a substantially close packed arrangement when the slide fastener is closed. Consequently, the gap between individual coupling elements on the same tape and also coupling elements on the opposing tape is particularly small when the slide fastener is closed in order to provide an attractive appearance and substantially straight line arrangement of the decorative elements when the slide fastener is closed.

The close packed arrangement of the coupling elements in the closed position and the rounded edges of the coupling elements in combination with the smooth edges of the decorative elements ensures that the material to which the slide fastener is secured is not readily trapped between the coupling elements and the decorative elements. In addition, if by chance material is trapped in the slide fastener, the coupling elements and decorative elements do not damage the material as there are no roughened surfaces on either the coupling elements or the decorative elements.

The smooth and substantially flat appearance of the slide fastener illustrated in FIG. 1 in combination with the decorative elements is both aesthetically pleasing to the eye and also to touch. As illustrated in FIG. 1, this arrangement of the coupling elements provides a dual row of decorative elements for use in clothing and also home furnishing.

Figure 2A:
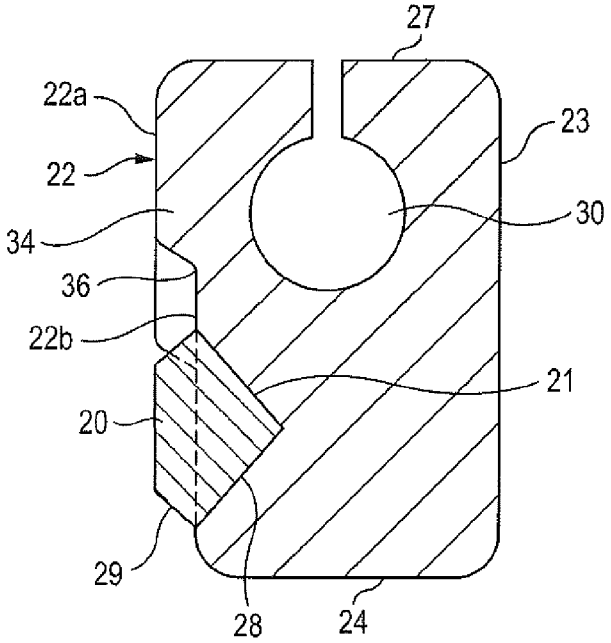
FIG. 2*a* is a cross-sectional view of a coupling element from the first embodiment of a slide fastener according to the present invention with decorative element.
Figure 2B:
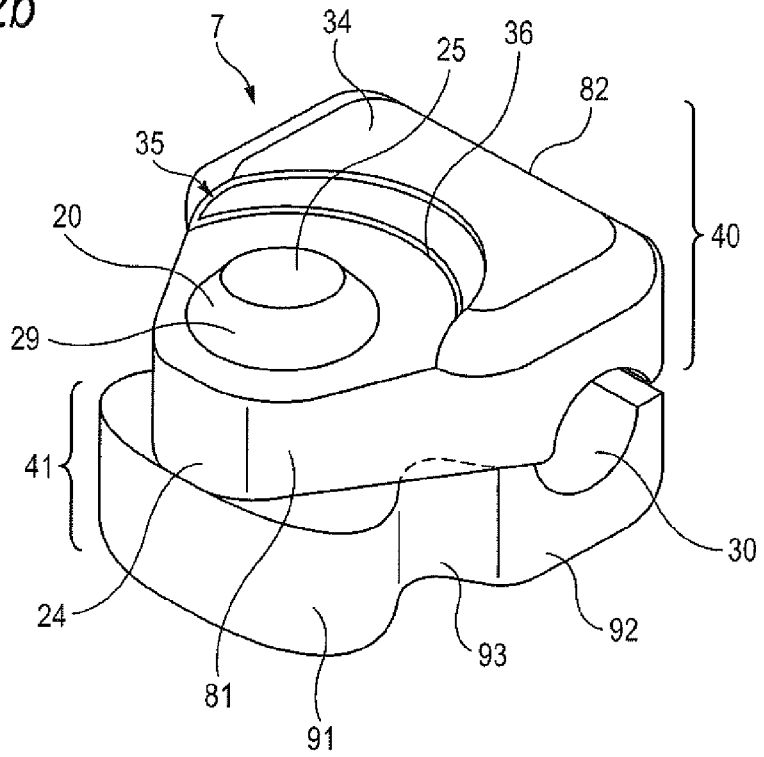
FIG. 2*b* is a perspective view of a coupling element from the first embodiment of a slide fastener according to the present invention with decorative element.
Figure 2C:
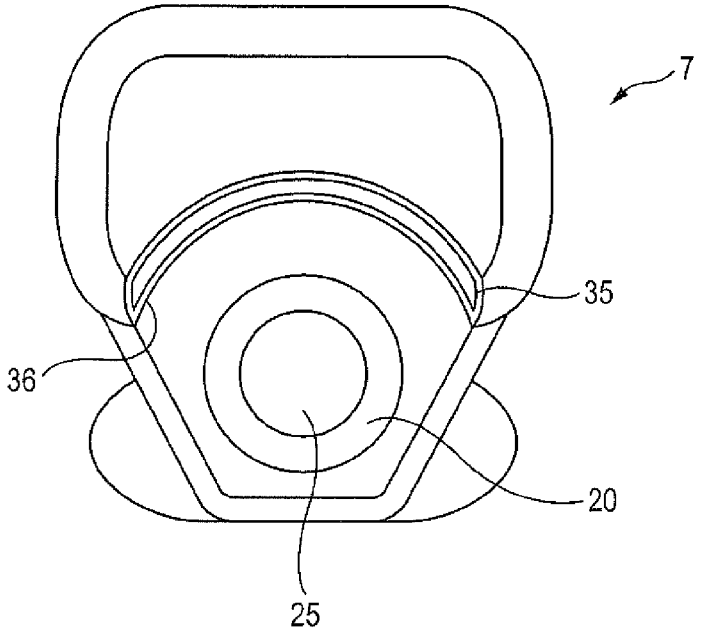
FIG. 2*c* is a top-plan view of a coupling element from the first embodiment of a slide fastener according to the present invention with decorative element.

In FIGS. 2*a*, 2*b* and 2*c* there is illustrated a coupling element with decorative elements attached according to a first embodiment of the present invention.

In FIG. 2*a*, the coupling element (7) is visible in cross-section and the decorative element (20) is visible also in cross-section. The coupling element (7) has an upper surface (22) at one side in the up-down direction and a lower surface (23) at another side in the up-down direction. The up-down direction of the coupling element (7) corresponds to the thickness direction of the coupling element (7) (i.e. a right-left direction in FIG. 2*a*). The coupling element (7) has a front face (24) at one side in the back-forth direction and a rear face (27) at another side in the back-forth direction. The back-forth direction of the coupling element (7) corresponds to the longitudinal direction of the coupling element (7) (i.e. an up-down direction in FIG. 2*a*). The upper surface (22) of the coupling elements (7) serves as an attachment surface to which the decorative element (20) is attached. The attachment surface has a first surface (22*a*) and a second surface (22*b*) which are different in height in the up-down direction. The first surface (22*a*) and the second surface (22*b*) are distinguished from each other with a boundary which is a step provided in the up-down direction of the coupling element (7). The first surface (22*a*) is located at high position and the second surface (22*b*) is located at low position relative to the first surface (22*a*). In the illustrated embodiment, the coupling element (7) has a recessed portion (36) which is recessed downwardly and a raised portion (34) which is raised upwardly relative to the recessed portion (36). The top surface of the raised portion (34) is the first surface (22*a*) and the bottom surface of the recessed portion (36) is the second surface (22*b*). The recessed portion (36) forms a recessed region for receiving the decorative element (20). The bottom surface of the recessed portion (36) is formed with a groove (21) which is recessed toward the lower surface (23) of the coupling element (7). The decorative element (20) has an upper portion (29) having a trapezoidal-shaped cross-section and a lower portion (28) having a triangular-shaped cross-section. The upper portion (29) may be formed into a truncated conical shape or a truncated pyramid shape. The lower portion (28) may be formed into a conical shape or a pyramid shape. The decorative element (20) is disposed on the recessed portion (36) of the coupling element (7) and the lower portion (28) of the decorative element (20) resides in the groove (21) of the coupling element (7). That is, the decorative element (20) is attached to the second surface (22*b*). The upper portion (29) of the decorative element (20) does not protrude upwardly beyond the first surface (22*a*) of the coupling element (7). The upper surface (22) of the coupling element (7) is a face which is positioned at a side of the upper face of the tape. The decorative element (20) is also positioned close to the front face (24) of the coupling element (7) and away from the rear face (27) of the coupling element (7) in the back-forth direction of the coupling element (7). The front face (24) of the coupling element (7) is the face which faces towards the stringer to which the opposing coupling elements are attached when the coupling elements are interdigitated.

In FIG. 2*b*, the coupling element (7) is illustrated in perspective view and the decorative element (20) is seen in position in the coupling element. It can be seen that an upper surface (25) of the upper portion (29) of the decorative element (20) is flat and does not protrude above the first surface (22*a*) of the coupling element (7). In addition, it can be seen that a rim or protective edge (35) is provided in the raised portion (34), which at least partially shields the upper portion (29) of the decorative element (20) which is recessed into the groove (21) and the recessed portion (36) is provided which also substantially encloses the decorative element (20).

In FIG. 2*c*, a top plan view of the coupling element (7) is visible which again illustrates the decorative element (20) in a recessed position in the coupling element (7) and the recessed portion (36) is provided which also substantially encloses the decorative element (20).

Also visible in FIGS. 2*a* and 2*b* is an orifice (30) which envelops the cord (6*a* or 6*b*) when the plastic coupling element is moulded onto the slide fastener. The decorative element (20) is not positioned directly above the orifice (30) and is positioned at a side of the front face (24) of the coupling element (7) relative to the orifice (30). With this structure, the decorative element (20) is positioned so as not to be positioned above the code.

It can also be seen from FIG. 2*b* that the coupling elements comprise an upper portion (40) and a lower portion (41) and that the decorative element (20) is recessed into the upper portion (40) of the coupling element. The upper portion (40) has an upper body portion (82) attached to the tape and an upper head portion (81) tapered so as to gradually decrease the width dimension thereof in the right-left direction of the coupling element (7) (i.e. a direction perpendicular to the up-down direction and the back-forth direction) toward a front side of the coupling element (7). On the other hand, the lower portion (41) has a lower body portion (92) attached to the tape, the lower head portion (91) expanded in the right-left direction of the coupling element (7), and an indented region (93) which connects the lower body portion (92) and the lower head portion (91) and narrows the width dimension thereof in the right-left direction relative to the lower body portion (92) and the lower head portion (91). The upper portion (40) is a first non-connecting portion and the upper head portion (81) is a tapered region which cannot be engaged with the opposing coupling element when the coupling elements are interdigitated. On the other hand, the lower portion (41) is a second connecting portion and the lower head portion (91) is a protruded region which can be engaged with the opposing coupling element when the coupling elements are interdigitated.

Figure 3A:
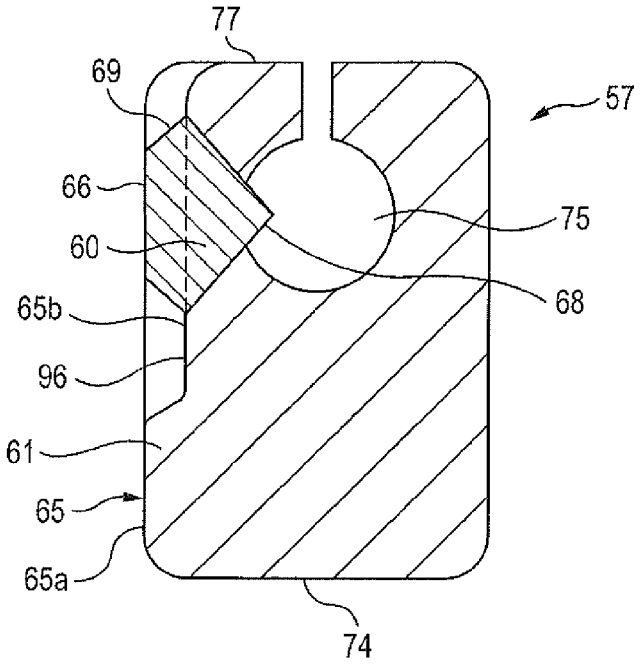
FIG. 3*a* is a cross-sectional view of a coupling element from the second embodiment of a slide fastener according to the present invention with decorative element.

In FIG. 3*a* there is illustrated a cross-sectional view of a coupling element (57) according to the second embodiment of the present invention, in which a decorative element (60) is again recessed with respect to the upper surface (65) of the coupling element (57). As well as the above-described first embodiment, the coupling element (57) has the upper surface (65) which serves as an attachment surface for the decorative element (60). The attachment surface has a first surface (65*a*) and a second surface (65*b*) which are different in position in the up-down direction. The first surface (65*a*) and the second surface (65*b*) are distinguished from each other with a boundary which is a step provided in the up-down direction of the coupling element (7). The first surface (65*a*) is located at high position and the second surface (65*b*) is located at low position. In the illustrated embodiment, the coupling element (57) has a recessed portion (96) which is recessed downwardly and a raised portion (61) which is raised upwardly relative to the recessed portion (96).

The top surface of the raised portion (61) is the first surface (65*a*) and the bottom surface of the recessed portion (96) is the second surface (65*b*). Consequently, the smooth upper surface (66) of the decorative element (60) is in alignment with the first surface (65*a*) of the coupling element (57) or extends beyond the first surface (65*a*) only to a limited extent. In addition, the decorative element (60) is positioned directly above the orifice (75) and the lower portion (68) of the decorative element (60) can be seen to protrude through the orifice (75) visible in FIGS. 3*a* and 3*b* respectively. The orifice (75) envelopes the code (6*a* and 6*b*) of the slide fastener and serves as means by which the coupling element (57) is secured to the cord (6*a* and 6*b*) on the slide fastener.

Figure 3B:
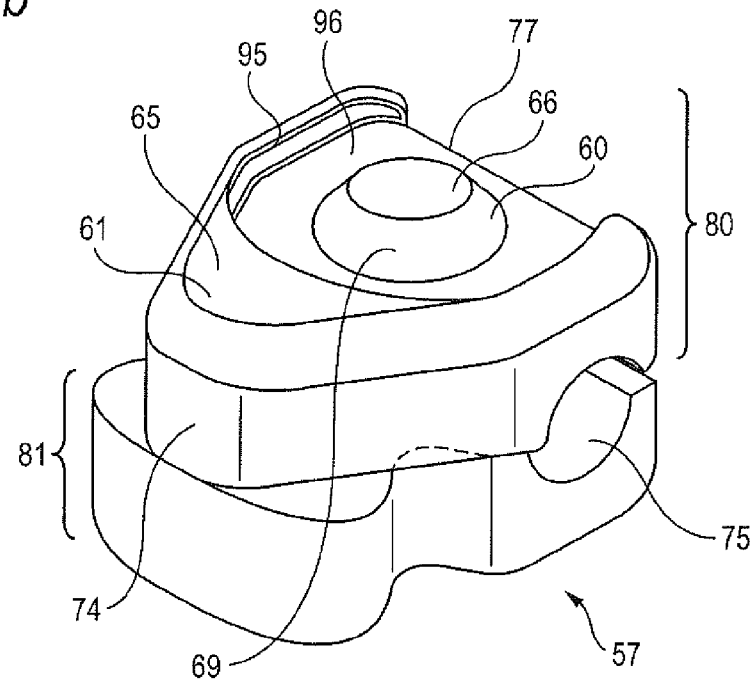
FIG. 3*b* is a perspective view of a coupling element from the second embodiment of a slide fastener according to the present invention with decorative element.

In FIG. 3*b* there is illustrated a perspective view of the coupling element (57) according to the second embodiment of the present invention. It can be seen that in this coupling element the decorative element (60) is located towards the rear face (77) of the coupling element (57) that is, away from the front face (74) of the coupling element (57). The coupling element (57) can be seen to be comprised of two portions, an upper portion (80) and a lower portion (81). The decorative element (60) resides in a recessed arrangement in the upper portion (80) of the coupling element. It can also be seen from FIG. 3*b* that the upper surface (66) of the upper portion (69) of the decorative element (60) does not protrude extensively out of the plane of the first surface (65*a*) of the coupling element (57). In addition, it can be seen that a rim or protective edge (95) is provided in the raised portion (61) which substantially shields the recessed decorative element (60) and a recessed portion (96) is provided which also substantially encloses the decorative element (60).

Figure 3C:
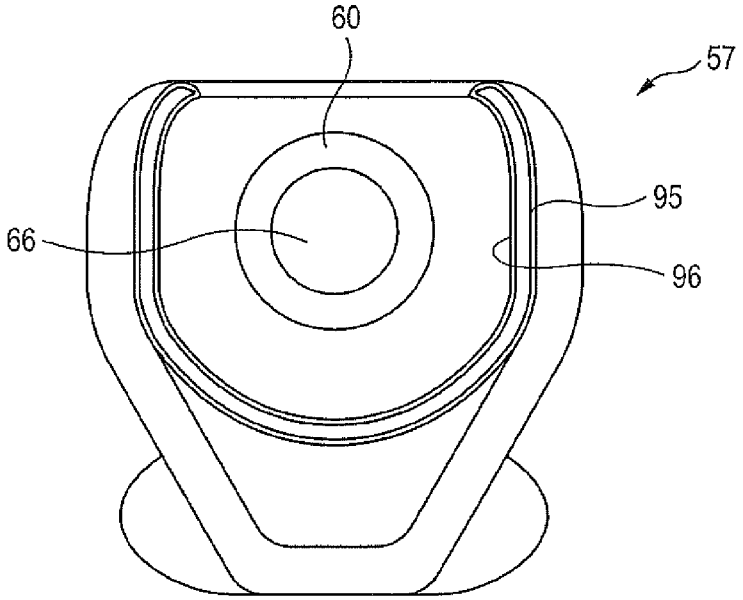
FIG. 3*c* is a top-plan view of a coupling element from the second embodiment of a slide fastener according to the present invention with decorative element.

Finally, in FIG. 3*c* there is illustrated a top plan view of the coupling element (57) according to the present invention wherein the decorative element (60) is located towards the rear of the coupling element and away from the front face (74) of the coupling element (57).

Figure 4:
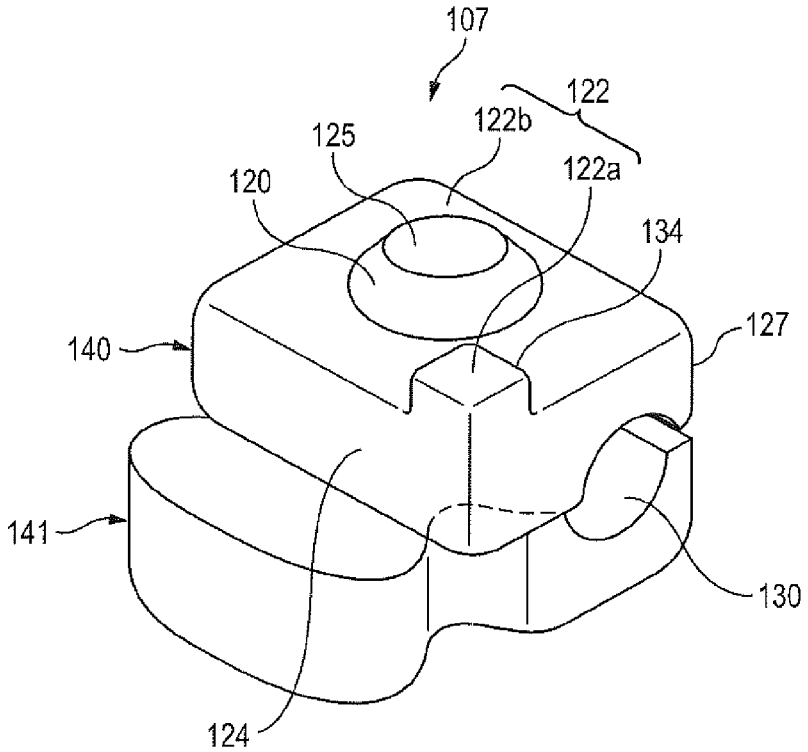
FIG. 4 is a perspective view of a coupling element from the third embodiment of a slide fastener according to the present invention with decorative element.

In FIG. 4 there is illustrated a perspective view of a coupling element (107) according to the third embodiment of the present invention, to which a decorative element (120) is attached. The coupling element (107) has an upper surface (122) which serves as an attachment surface for the decorative element (120). The attachment surface has a first surface (122*a*) and a second surface (122*b*) which are different in height in the up-down direction of the coupling element (107). The first surface (122*a*) is higher than the second surface (122*b*). In the illustrated embodiment, a raised portion (134) is provided in the upper surface (122), which is raised upwardly relative to the other portion in the upper surface (122). The top surface of the raised portion corresponds to the first surface (122*a*) and the top surface of the other portion corresponds to the second surface (122*b*).

The decorative element (120) is disposed on the second surface (122*b*). The upper surface (125) of the decorative element (120) is flat. In the illustrated embodiment, the upper surface (125) of the decorative element (120) does not protrude upwardly beyond the first surface (122*a*). The upper surface (125) of the decorative element (120) may be in alignment with the first surface (122*a*). In some embodiments, it may be acceptable that the upper surface (125) of the decorative element (120) extends upwardly beyond the first surface (122*a*) only to a limited extent. The decorative element (120) may have the same structure as the decorative element (20) according to the first embodiment of the present invention.

The coupling element (107) according to the third embodiment of the present invention is comprised of an upper portion (140) and a lower portion (141). The upper portion (140) has a substantially square shape and serves as the first non-connecting portion. Since the attachment surface corresponds to the upper surface of the upper portion (140), the attachment surface (i.e. the upper surface (122) of the coupling element (107)) also has a substantially square shape. The lower portion (141) has a body portion attached to the tape, a head portion expanded in the right-left direction of the coupling element (107), and an indented region which connects the body portion and the head portion and narrows the width dimension thereof in the right-left direction relative to the body portion and the head portion. The head portion is a protruded region which can be engaged with the opposing coupling element when the coupling elements are interdigitated (i.e. when the slide fastener is closed) and thus the lower portion (141) serves as the second connecting portion. The lower portion (141) may have the same structure as the lower portion (41) according to the first embodiment of the present invention. The upper portion (141) is located above the body portion and the indented region so that the upper surface of the head portion of the lower portion (141) is exposed to the outside. Accordingly, the decorative element (120) is positioned close to the rear face (127) of the coupling element (107) in the back-forth direction of the coupling element (107), as compared with the decorative element (20) according to the first embodiment.

The coupling element (107) according to the third embodiment of the present invention has an orifice (130) which envelopes the code (6*a* or 6*b*) when the coupling element (107) is moulded onto the tape. The orifice is formed on the rear face (127) of the coupling element (107). The decorative element (120) is positioned directly above the orifice (130) and thus a part of the decorative element (120) may protrude into the orifice (130).

The raised portion (134) is positioned at one corner of the square-shaped attachment surface. In the illustrated embodiment, the raised portion (134) is positioned close to a front face (124) of the coupling element (107) at one side in the right-left direction of the coupling element (107).

The coupling element (107) according to the third embodiment differs from the coupling element (7) according to the first embodiment and the coupling element (57) according to the second embodiment in that:

(1) The upper portion (140) has a substantially square shape and does not have a head portion having a tapered shape toward a front side of the coupling element;

(2) The raised portion (134) is disposed at one corner of the square-shaped attachment surface (the upper surface (122)) and does not surrounds the decorative element (120); and (3) There is no region on the attachment surface, which corresponds to the recessed portion (36 or 96) forming the recessed region, according to the first or second embodiment.

In accordance with the present invention, and as illustrated by the first to third embodiments in FIGS. 2*b*, 3*b* and 4 respectively it can be seen that the decorative element is recessed into the upper portion (40, 80, 140) of the coupling element (7, 57, 107) respectively.

This can be achieved in a number of ways. For example, prior to formation of the coupling element by injection moulding and starting from a piece of flat plastics material, the decorative element may be placed onto an upper surface of the flat starting material such that when the coupling element is injection moulded, the molten plastic surrounds and traps the decorative element on the upper surface of the coupling element. It will be appreciated by one skilled in the art that this procedure could also be achieved by forming the coupling element by injection moulding followed by insertion of the decorative element into a preformed groove after formation of the coupling element.

Alternatively, the coupling element may be injection moulded and whilst the molten plastic is still in a maleable state the decorative element may be placed in position in the maleable plastic such that the decorative element 'sinks' into position in the coupling element. In all cases, once the coupling element has been cooled, a plastic lip or seal forms around the edge of the decorative element ensuring that the decorative element is held in place.

It is possible that if the crystal is inserted into the coupling element after the moulding of the coupling element has taken place that adhesive may also be used to ensure that the decorative elements are held firmly in place.

It is possible to use alternative methods to make moulded plastic coupling element. For example, the coupling element may be treated or heated with sonic or radiowaves such as for example, radio waves, sonic waves or microwaves. Alternatively, a variety of heat sources may be applied to the plastic to melt the plastic into the desired coupling element shape.

It will also be appreciated by one skilled in the art that this technology can also be applied not only to the incorporation of decorative elements into the coupling elements as required but the same techniques may also be applied to the provision of plastic sliders, plastic pull tabs and plastic end stops or top stops to which the required decorative elements may be applied in order to match the desired slide fastener.

With respect to closure of the slide fastener please be advised as follows. As can be seen in FIG. 2*b*, the coupling element (7) comprises the first non-connecting portion (the upper portion) (40) and the second connecting portion (the lower portion) (41). The substantially tapered shaped nature of the first non-connecting portion (40) toward the front face (74) of the coupling element (7) is apparent. As described previously, the second connecting portion comprises the lower head portion (91) and the lower body portion (92) which are connected at the indented region (93). The lower head portion (91) has an expanded shape relative to the indented region (93). When the slide fastener is in the closed position the head portions (91) on individual coupling elements engage between the indents (93) formed by adjacent coupling elements on opposing tapes. The interdigitating second connecting portions connect in a closely packed arrangement such that the first non-connecting portions on adjacent coupling elements also abut one another closely.

The inventors have surprisingly found that whilst the coupling elements (7) for example in FIG. 2*b* comprise a first non-connecting portion (40) and a second connecting portion (41) and whilst it is only the second connecting portion (41) of the coupling elements which interdigitate in the closed slide fastener, when the slide fastener is in the closed position the strength of attachment of the coupling elements is still surprisingly strong. This is surprising since effectively only half of each coupling element is engaged in interdigitation in the closed slide fastener. Nevertheless, it has been found that it is surprisingly difficult to separate the interdigitating coupling elements when in the closed or locked position. Further, it has been found that when the slide fastener is in the closed position the engaged coupling elements still allow the slide fastener to have great flexibility such that the coupling elements are not readily separated even when the closed slide fastener is flexed along the longitudinal length of the fastener.

The invention claimed is:

1. A slide fastener comprising:

a pair of first and second stringers each comprising a tape and a row of coupling elements mounted on one longitudinal edge of the tape; wherein each of the coupling elements comprises a first non-connecting portion and a second connecting portion and wherein the second connecting portion comprises a head portion and a body portion; and wherein the first non-connecting portion comprises an attachment surface to which a decorative element is attached and the attachment surface has a first surface and a second surface lower than the first surface, and wherein the decorative element is attached to the second surface such that a part of the second surface is exposed.

2. The slide fastener according to claim 1 wherein the coupling elements are comprised of plastic.

3. The slide fastener according to claim 1 wherein the decorative element comprises a bead or a crystal.

4. The slide fastener according to claim 1 wherein the decorative element does not protrude beyond the first surface of each of the coupling elements.

5. The slide fastener according to claim 1 wherein the decorative element comprises an upper portion and a lower portion and wherein an upper surface of the upper portion is substantially flat.

6. The slide fastener according to claim 1 wherein the first non-connecting portion comprises a raised portion and the raised portion comprises the first surface.

7. The slide fastener according to claim 6 wherein the raised portion at least partially surrounds the decorative element.

8. The slide fastener according to claim 1 wherein the first non-connecting portion comprises a recessed region in addition to a groove for receiving the decorative element.

9. The slide fastener according to claim 8 wherein the recessed region comprises a recessed portion and the recessed portion comprises the second surface.

10. The slide fastener according to claim 1 wherein the first non-connecting portion has a tapered region.

11. The slide fastener according to claim 1 wherein the second connecting portion comprises an indented region and a protruding region for engaging adjacent coupling elements.

12. A method of preparing the slide fastener according to claim 1 comprising a step of:

securing a series of the coupling elements along a longitudinal length of facing sides of the tape forming each stringer of the slide fastener by injection moulding plastic material; and wherein one or more of the decorative elements are applied and secured to one or more of the coupling elements.

13. The method of preparing the slide fastener according to claim 12 wherein the coupling elements are re-heated prior to insertion of the decorative elements.

14. The method of preparing the slide fastener according to claim 13 wherein the coupling elements are re-heated using sonic or radio waves prior to insertion of the decorative elements.

15. The method of preparing the slide fastener according to claim 12 wherein the decorative elements are further secured to the coupling elements by adhesive.

16. The slide fastener according to claim 1, wherein the attachment surface includes an upper surface of the first non-connecting portion, wherein the first surface and the second surface are flat, wherein a step in an up-down direction separates the first surface and the second surface, and the decorative element protrudes from the second surface.

* * * * *

UNITED STATES PATENT AND TRADEMARK OFFICE

CERTIFICATE OF CORRECTION

PATENT NO. : 9,307,810 B2
APPLICATION NO. : 14/111294
DATED : April 12, 2016
INVENTOR(S) : Naoyuki Himi It is certified that error appears in the above-identified patent and that said Letters Patent is hereby corrected as shown below:

In the specification,

In column 4, line 65, delete “potion” and insert -- portion --, therefor.

Signed and Sealed this
Seventh Day of June, 2016

Michelle K. Lee

Michelle K. Lee
*Director of the United States Patent and Trademark Office*